US005567891A

United States Patent [19]

Bogatin et al.

[11] Patent Number: 5,567,891

[45] Date of Patent: Oct. 22, 1996

[54] RARE EARTH ELEMENT-METAL-HYDROGEN-BORON PERMANENT MAGNET

[75] Inventors: Jacob G. Bogatin, Richboro, Pa.; Andrey Belov, Budapest, Hungary

[73] Assignee: YBM Technologies, Inc., Newtown, Pa.

[21] Appl. No.: 437,719

[22] Filed: May 8, 1995

Related U.S. Application Data

[63] Continuation of Ser. No. 191,999, Feb. 4, 1994, Pat. No. 5,454,998.

[51] Int. Cl.[6] ..... C22C 30/00

[52] U.S. Cl. ..... 75/244; 75/245; 75/246; 148/302

[58] Field of Search ..... 75/244, 245, 246; 148/104, 302

[56] References Cited

U.S. PATENT DOCUMENTS

| | | |
|---|---|---|
| 4,588,439 | 5/1986 | Narasimhan et al. . |
| 4,597,938 | 7/1986 | Matsuura et al. . |
| 4,601,875 | 7/1986 | Yamamoto et al. . |
| 4,663,066 | 5/1987 | Fruchart et al. . |
| 4,664,724 | 5/1987 | Mizoguchi et al. . |
| 4,684,406 | 8/1987 | Matsuura et al. . |
| 4,723,994 | 2/1988 | Ovshinsky et al. . |
| 4,767,450 | 8/1988 | Ishigaki et al. . |
| 4,767,474 | 8/1988 | Fujimura et al. . |
| 4,770,723 | 9/1988 | Sagawa et al. . |
| 4,793,874 | 12/1988 | Mizoguchi et al. . |
| 4,802,931 | 2/1989 | Croat . |
| 4,853,045 | 8/1989 | Rozendaal . |
| 4,878,964 | 11/1989 | Mizoguchi et al. . |
| 4,891,078 | 1/1990 | Ghandehari . |
| 4,981,532 | 1/1991 | Takeshita et al. . |
| 5,085,715 | 2/1992 | Tokunaga et al. . |
| 5,091,020 | 2/1992 | Kim . |
| 5,096,512 | 3/1992 | Sagawa et al. . |
| 5,114,502 | 5/1992 | Bogatin . |
| 5,122,203 | 6/1992 | Bogatin . |
| 5,127,970 | 7/1992 | Kim . |
| 5,129,964 | 7/1992 | Anderson . |
| 5,143,560 | 9/1992 | Doser . |
| 5,147,447 | 9/1992 | Takeshita et al. . |
| 5,147,473 | 9/1992 | Udea et al. . |
| 5,162,064 | 11/1992 | Kim et al. . |
| 5,180,445 | 1/1993 | Bogatin . |
| 5,227,247 | 7/1993 | Bogatin . |
| 5,228,930 | 7/1993 | Nakayama et al. . |
| 5,250,206 | 10/1993 | Nakayama et al. . |

FOREIGN PATENT DOCUMENTS

| | | |
|---|---|---|
| 0173588 | 3/1986 | European Pat. Off. . |
| 0414645A1 | 2/1991 | European Pat. Off. . |
| 61-238938 | 3/1987 | Japan . |
| 62-170455 | 1/1988 | Japan . |
| 62-70454 | 1/1988 | Japan . |
| 63-086832 | 8/1988 | Japan . |
| 4-107244 | 4/1992 | Japan . |

*Primary Examiner*—Ngoclan Mai

*Attorney, Agent, or Firm*—Caesar, Rivise, Bernstein, Cohen & Pokotilow, Ltd.

[57] ABSTRACT

A permanent magnet is provided which is comprised of, by atomic percent: 10–24% R; 2–28% boron, 0.1–18.12% hydrogen; and balance being M. R is at least one element selected from La, Ce, Pr, Nd, Pm, Sm, Eu, Gd, Tb, Dy, Ho, Er, Tm, Yb, Lu, Y and Sc, and M is at least one metal selected from Fe, Co, Ni, Li, Be, Mg, Rs, Si, Ti, V, Cr, Mn, Cu, Zn, Ga Ge, Zn, Nb, Mo, Ru, Rh, Pd, Ag, Sb, Te, Hf, Ta, W, Re, Os, Ir, Pt, Au, and Bi. A process for producing the rare earth element-metal-hydrogen boron magnets is also disclosed wherein the magnetic materials are treated in an atmosphere having partial pressures of hydrogen containing gas at temperatures below the phase transformation temperature of the rare earth element-metal hydrides prior to sintering.

5 Claims, No Drawings

RARE EARTH ELEMENT-METAL-HYDROGEN-BORON PERMANENT MAGNET

This is a continuation of application Ser. No. 08/191,999 filed on Feb. 4, 1994, U.S. Pat. No. 5,454,998.

FIELD OF THE INVENTION

This invention generally relates to magnetic materials and, more particularly, to rare earth element-containing powders and permanent magnets which contain hydrogen, and a process for producing the same.

BACKGROUND OF THE INVENTION

Permanent magnet materials currently in use include alnico, hard ferrite and rare earth element-cobalt magnets. Recently, new magnetic materials have been introduced containing iron, various rare earth elements and boron. Such magnets have been prepared from melt quenched ribbons and also by the powder metallurgy technique of compacting and sintering, which was previously employed to produce samarium cobalt magnets.

Suggestions in the prior art for rare earth element permanent magnets and processes for producing the same include: U.S. Pat. No. 4,597,938. Matsuura et al. which discloses a process for producing permanent magnet materials of the Fe-B-R type by: preparing a metallic powder having a mean particle size of 0.3–80 microns and a composition consisting essentially of, in atomic percent, 8–30% R representing at least one of the rare earth elements inclusive of Y, 2 to 28% B and the balance Fe; compacting and sintering the resultant body at a temperature of 900°–1200° C. in a reducing or non-oxidizing atmosphere. Co up to 50 atomic percent may be present. Additional elements M (Ti, Ni, Bi, V, Bb, Ta, Cr, Mo, W, Mn, Al, Sb, Ge, Sn, Zr, Hf) may be present. The process is applicable for anisotropic an isotropic magnet materials. Additionally, U.S. Pat. No. 4,684,406, Matsuura et al., discloses a certain sintered permanent magnet material of the Fe-B-R type, which is prepared by the aforesaid process.

Also, U.S. Pat. No. 4,601,875, Yamamoto et al. teaches permanent magnet materials of the Fe-B-R type produced by: preparing a metallic powder having a mean particle size of 0.3–80 microns and a composition of, in atomic percent, 8–30% R representing at least one of the rare earth elements inclusive of Y, 2–28% B and the balance Fe; compacting: sintering at a temperature of 900°–1200° C.; and, thereafter, subjecting the sintered bodies to heat treatment at a temperature lying between the sintering temperature and 350° C. Co and additional elements M (Ti, Ni, Bi, V, Nb, Ta, Cr, Mo, W, Mn, Al, Sb, Ge, Sn, Zr, Hf) may be present. Furthermore, U.S. Pat. No. 4,802,931, Croat, discloses an alloy with hard magnetic properties having the basic formula $RE_{1-x}(TM_{1-y}B_y)_x$. In this formula, RE represents one or more rare earth elements including scandium and yttrium in Group IIIA of the periodic table and the elements from atomic number 57 (lanthanum) through 71 (lutetium). TM in this formula represents a transition metal taken from the group consisting of iron or iron mixed with cobalt, or iron and small amounts of other metals such as nickel, chromium or manganese.

Another example of a rare earth element-iron-boron and rare earth element-iron-boron hydride magnetic materials is presented in U.S. Pat. No. 4,663,066 to Fruchart et al. The Fruchart et al. patent teaches a new hydrogen containing alloy which contains H in an amount ranging from 0.1–5 atomic percent. The alloy of Fruchart et al. is prepared by a process wherein the rare earth element-iron-boron compound at room temperature is hydrogenated under a hydrogen pressure above 10 bar ($10\times10^5$ Pa) and below 500 bar ($500\times 10^5$ Pa). Following the hydrogenation process, the compound is subjected to a dehydrogenation cycle by subjecting it to temperatures ranging from 150° C. to 600° C., whereby all of the hydrogen is removed.

Still another example of a rare earth element-iron-boron magnetic material is presented in U.S. Pat. No. 4,588,439 to Narasimhan et al., which describes a permanent magnet material of rare earth element-iron-boron composition along with 6,000–35,000 ppm oxygen.

However, prior art attempts to manufacture permanent magnets containing rare earth element-iron-boron compositions utilizing powder metallurgy technology have suffered from substantial shortcomings. In particular, these inventions teach that the rare earth element-iron-boron magnetic material has a very high selectivity to hydrogen. As a result, in commercial applications, hydrogen which is present in a normally humid atmosphere is easily absorbed by the magnet alloy and causes the disintegration thereof.

OBJECT OF THE INVENTION

With regard to the above shortcomings which have heretofore been apparent when rare earth element-iron-boron alloys are subjected to hydrogenating conditions, it is an object of the present invention to provide a permanent magnet of the type comprising a rare earth element-metal (e.g.,iron)-hydrogen-boron alloy which has high magnetic properties and elevated corrosion resistance. It is a further object of the invention to provide a process for preparing permanent magnets by treating a rare earth element-metal-boron material, such as an alloy, powder, green compact or permanent magnet material, in a hydrogen atmosphere at a temperature below the phase transformation temperatures of the rare earth element-metal hydrides, including temperatures below room temperature.

SUMMARY OF THE INVENTION

A permanent magnet is provided which is comprised of, atomic percent: 10–24% R; 2–28% boron; 0.1–18.12% hydrogen; and balance being M. R is at least one element selected from group consisting of: La, Ce, Pr, Nd, Pm, Sm, Eu, Gd, Tb, Dy, Ho, Er, Tm, Yb, Lu, Y and Sc, and M is at least one metal selected from group consisting of: Fe, Co, Ni, Li, Be, Mg, As Aa, Si, Ti, V, Cr, Mn, Cu, Zn, Ga Ge, Zn, Nb, Mo, Ru, Rh, Pd, Ag, Sb, Te, Hf HF, Ta, W, Re, Os, Ir, Pt, Au, and Bi. The magnets produced according to the invention are permanent magnets containing from 0.1 to 18.12 atomic percent hydrogen and have high magnetic properties, e.g., residual induction (Br) up to 14.7 kG and maximum energy product (BHmax) up to 52.5 MGOe. In addition, the permanent magnets according to this invention have elevated corrosion resistance.

In the preferred process for forming the rare earth element-metal-hydrogen-boron magnets of the invention, one of the rare earth elements or a combination thereof, the metal and boron, as either the alloy, the powder form, green compact or as permanent magnet material, are first compacted, if that has not already been done. The compacted sample is heated to at least the temperature necessary to achieve complete outgassing of the sample and is maintained in a high vacuum until outgassing is completed.

Thereafter, a partial pressure of hydrogen-containing gas is applied to the sample and the sample is heated in the hydrogen atmosphere to a temperature below the phase transformation temperature of the metal hydride and held at that temperature for the time necessary to saturate the sample with hydrogen and achieve the necessary atomic percent of hydrogen in the sample. At the end of this heating, the hydrogen is replaced with argon, and the sample is thereafter heated again to the sintering temperature for the time necessary to achieve the required density of the magnet. Following the sintering, the resultant magnet is treated at 300° C. to 900° C. for approximately three hours in a partial pressure of argon, whereupon the formation and treatment process is completed.

DETAILED DESCRIPTION OF THE PREFERRED EMBODIMENT

Other objects and many of the attendant advantages of the instant invention will be readily appreciated as the same becomes better understood by reference to the following detailed description. In particular, this invention relates to permanent magnets of the rare earth element-metal-hydrogen-boron type. These magnets have been shown to have increased magnetic properties as well as increased corrosion resistance.

In the preferred embodiment, the permanent magnet is comprised of 10–24 atomic percent of at least one rare earth element; 2–28 atomic percent boron; 0.1–18.12 atomic percent hydrogen, with the remaining balance being at least one metal. The rare earth element (R) includes at least one element selected from La Ce, Pr, Nd, Pm, Sm, Eu, Gd, Tb, Dy, Ho, Er, Tm, Yb, Lu, Y and Sc or a combination thereof. The metal (M) includes at least one element selected from the group consisting of: Fe, Co, Ni, Li, Be, Mg, As, Si, Ti, V, Cr, Mn, Cu, Zn, Ga Ge, Zn, Nb, Mo, Ru, Rh, Pd, Ag, Sb, Te, Hf, Ta, W, Re, Os, Ir, Pt, Au, and Bi, and is preferably iron.

The introduction of a selected amount of hydrogen into the rare earth element-metal-boron crystal lattice forms a chemical composition of rare earth element and metal hydrides which results in the formation of the specific structure conditions in grain boundaries that lead to the nucleating and growth of the magnetic properties. The availability of hydrogen diffused within the crystal lattice of the material makes it possible to reduce the number of impurities and their harmful effects, thus resulting in high corrosion resistance.

Permanent magnets comprising at least one of the rare earth elements, at least one metal, hydrogen and boron have levels of magnetic properties which would not exist without the inclusion of hydrogen. The inclusion of hydrogen in the selected amounts disclosed herein has increased the level of magnetic properties, particularly the residual induction and maximum energy product, which have been shown to be as high as 14.7 kG and 52.5 MGOe, respectively. Furthermore the permanent magnets have shown increased corrosion resistance; for example, after treatment one of the permanent magnets prepared according to the present invention in 95% relative humidity for 500 hours at 85° C., the weight gain was less than 0.0008 g/cm$^2$.

The permanent magnets according to the present invention also have been shown to have good workability or formability, which makes it possible to manufacture extremely small magnets in the range of 0.5 mm with good results. This must be compared with the usual workability of such magnets without the inclusion of the hydrogen component which are usually extremely brittle and difficult to shape into such small sizes. Magnets according to the present invention are far less brittle and are more easily shaped into these desired smaller sizes.

In the preferred process for forming the rare earth element-metal-hydrogen-boron magnets of the invention, the compounds are prepared as follows. The rare earth element or a combination thereof, the metal (or a combination thereof) and boron (provided as either the alloy, a powder, a green compact or as a permanent magnet) are first compacted, if that has not already been achieved. The compacted sample is heated in a vacuum to the temperature necessary to obtain complete outgassing of the sample. In this instance, the sample is heated to 200° C. and held for 45 minutes in a vacuum at $10^{-6}$ Torr. Thereafter, a partial pressure of hydrogen containing gas is applied to the sample and the sample is heated in the hydrogen containing gas to a temperature below the phase transformation temperature of the metal hydride for the time necessary to saturate the sample with hydrogen, i.e., achieve the necessary atomic percent of hydrogen in the sample. (As will be shown, the magnetic properties of the resultant magnet can be varied with the atomic percent of hydrogen obtained in the sample as a result of varying the partial pressure of the hydrogen containing gas.) In the present invention, it is preferred to heat the sample to 950° C. and hold it for 30 minutes in the partial pressure hydrogen environment. At the end of the 30 minutes, the hydrogen is replaced with argon (preferably 5" Hg) and the sample is heated to the sintering temperature for the time necessary to obtain the required density in the finished magnet product. In the present embodiment, the sample is subjected to the argon at 5" Hg and sintered at 1090° C. for three more hours. Following the sintering, the resultant magnet is heat treated at temperatures between 300° C. and 900° C. for up to three hours in a partial pressure of argon. In the preferred embodiment, the sintered magnet is treated at 900° C. for 1 hour and at 650° C. for two additional hours in a partial pressure of argon of 1" Hg. At the end of this final heat treatment step, the permanent magnet formation and treatment is complete.

The following examples were prepared according to the above procedure. In each example, the starting rare earth element-metal-boron powder contained, in weight percent: 31% Nd+3% Dy, 1.1% boron and the balance was iron. The variable in each example is the partial pressure of hydrogen used to treat the compacted sample.

EXAMPLE 1

In the first example, the process was conducted using a hydrogen containing gas having a partial pressure $4\times10^{-5}$ Torr. The resulting hydrogen concentration in the magnets before exposure to air was 0.1 at % (atomic percent.) The results of the treatment with hydrogen at a partial pressure of $4\times10^{-5}$ Torr are set forth in Table 1. Furthermore, the average weight gain of the magnet after exposure to a relative humidity of 95% at 85° C. for 500 hours was 0.015 g/cm$^2$.

TABLE 1

| Number | Residual Induction Br (kG) | Coercive Force Hc (kOe) | Coercive Force Hci (kOe) | Maximum Energy Product BH (MGOe) | Hydrogen |
|---|---|---|---|---|---|
| HN-1 | 11.85 | 9.58 | 15.86 | 30.94 | 0.1 at % |
| HN-2 | 11.42 | 10.1 | 16.02 | 30.21 | 0.1 at % |
| HN-3 | 11.60 | 9.96 | 14.63 | 30.44 | 0.1 at % |
| HN-4 | 11.25 | 9.42 | 15.94 | 30.35 | 0.1 at % |
| HN-5 | 12.09 | 9.85 | 16.43 | 31.76 | 0.1 at % |

EXAMPLE 2

In the second example, the samples were subjected to a hydrogen containing gas having a partial pressure of 0.5 Torr. As set forth in Table 2, the hydrogen concentration in the magnets of the second example, before exposure to air, ranged from 0.41–0.54 at % (atomic percent). Furthermore, the average weight gain after exposure to a relative humidity of 95% at 85° C. for 500 hours was 0.0009 g/cm$^2$.

TABLE 2

| Number | Br (kG) | Hc (kOe) | Hci (kOe) | BH (MGOe) | Hydrogen |
|---|---|---|---|---|---|
| H5-1 | 12.72 | 10.65 | 14.44 | 34.12 | 0.41 at % |
| H5-2 | 12.45 | 10.81 | 15.33 | 34.02 | 0.49 at % |
| H5-3 | 12.41 | 10.65 | 15.03 | 35.11 | 0.52 at % |
| H5-4 | 12.72 | 10.89 | 14.19 | 36.24 | 0.54 at % |
| H5-5 | 12.68 | 10.12 | 14.83 | 35.12 | 0.51 at % |

EXAMPLE 3

In the third example, the samples were subjected to a hydrogen containing gas having a partial pressure of 0.75 Torr. As set forth in Table 3, the hydrogen concentration on the magnets before exposure to air ranged from 0.78–0.88 at % (atomic percent). Furthermore, the average weight gain after exposure to a relative humidity of 95% at 85° C. for 500 hours was 0.0011 g/cm$^2$.

TABLE 3

| Number | Br (kG) | Hc (kOe) | Hci (kOe) | BH (MGOe) | Hydrogen |
|---|---|---|---|---|---|
| H10-1 | 13.64 | 12.25 | 13.82 | 42.22 | 0.85 at % |
| H10-2 | 13.78 | 12.44 | 13.66 | 44.88 | 0.79 at % |
| H10-3 | 13.66 | 12.28 | 14.01 | 42.39 | 0.86 at % |
| H10-4 | 13.48 | 12.03 | 14.23 | 32.81 | 0.78 at % |
| H10-5 | 13.71 | 12.41 | 14.11 | 45.01 | 0.88 at % |

EXAMPLE 4

In the fourth example, the samples were subjected to a hydrogen containing gas having a partial pressure of 1.1 Torr. As set forth in Table 4, the hydrogen concentration on the magnets before exposure to air ranged from 1.20–1.29 at % (atomic percent). Furthermore, the average weight gain after exposure to a relative humidity of 95% at 85° C. for 500 hours was 0.0025 g/cm$^2$.

TABLE 4

| Number | Br (kG) | Hc (kOe) | Hci (kOe) | BH (MGOe) | Hydrogen |
|---|---|---|---|---|---|
| H14-1 | 12.84 | 11.44 | 14.01 | 35.86 | 1.29 at % |
| H14-2 | 12.78 | 11.25 | 13.98 | 35.54 | 1.21 at % |
| H14-3 | 12.81 | 11.64 | 14.12 | 36.39 | 1.20 at % |
| H14-4 | 12.89 | 11.36 | 15.11 | 36.95 | 1.29 at % |
| H14-5 | 12.92 | 11.51 | 14.98 | 37.02 | 1.22 at % |

EXAMPLE 5

In the fifth example, the samples were subjected to a hydrogen containing gas having a partial pressure of 1.5 Torr. As set forth in Table 5, the hydrogen concentration on the magnets before exposure to air ranged from 1.94–2.02 at % (atomic percent). Furthermore, the average weight gain after exposure to a relative humidity of 95% at 85° C. for 500 hours was 0.0032 g/cm$^2$.

TABLE 5

| Number | Br (kG) | Hc (kOe) | Hci (kOe) | BH (MGOe) | Hydrogen |
|---|---|---|---|---|---|
| H60-1 | 11.65 | 9.44 | 16.05 | 29.85 | 1.98 at % |
| H60-2 | 11.04 | 9.56 | 15.86 | 29.84 | 2.02 at % |
| H60-3 | 11.84 | 9.88 | 16.19 | 30.04 | 1.98 at % |
| H60-4 | 11.25 | 9.76 | 15.94 | 29.05 | 1.99 at % |
| H60-5 | 11.93 | 10.08 | 16.25 | 30.80 | 1.94 at % |

EXAMPLE 6

In the fifth example, the samples were subjected to a hydrogen containing gas having a partial pressure of 5 Torr. As set forth in Table 6, the hydrogen concentration on the magnets before exposure to air ranged from 17.98–18.12 at % (atomic percent). Furthermore, the average weight gain after exposure to a relative humidity of 95% at 85° C. for 500 hours was 0.0051 g/cm$^2$.

TABLE 6

| Number | Br (kG) | Hc (kOe) | Hci (kOe) | BH (MGOe) | Hydrogen |
|---|---|---|---|---|---|
| H80-1 | 6.44 | 4.84 | 6.84 | 9.12 | 18.02 at % |
| H80-2 | 7.25 | 5.25 | 7.18 | 12.1 | 18.11 at % |
| H80-3 | 6.99 | 5.12 | 6.83 | 11.24 | 18.00 at % |
| H80-4 | 6.77 | 4.12 | 6.04 | 9.88 | 17.98 at % |
| H80-5 | 6.45 | 5.03 | 7.22 | 8.11 | 18.12 at % |

As can be seen from the foregoing data, the increase in hydrogen in the rare earth element-metal-hydrogen-boron magnet material according to the process of the present invention results in increased magnetic properties and improved corrosion resistance.

Without further elaboration, the foregoing will so fully illustrate our invention that others may, by applying current for future knowledge, adopt the same for use under various conditions.

We claim:

1. A permanent magnet comprising, by atomic percent:

10–24% R;

2–28% boron;

greater than 0.3%–18.12% hydrogen; and balance being M, wherein R is at least one element selected from group consisting of: La, Ce, Pr, Nd, Pm, Sm, Eu, Gd, Tb, Dy, Ho, Er, Tm, Yb, Lu, Y and Sc, and wherein M is at least one metal selected from group consisting of: Fe, Co, Ni, Li, Be, Mg, As, Si, Ti, V, Cr, Mn, Cu, Zn, Ga Ge, Zn, Nb, Mo, Ru, Rh, Pd, Ag, Sb, Te, Hf, Ta, W, Re, Os, Ir, Pt, Au, and Bi.

2. A permanent magnet as claimed in claim 1, wherein hydrogen is 0.5–1.94 atomic percent.

3. A permanent magnet as claimed in claim 1, wherein hydrogen is 0.85–1.25 atomic percent.

4. A permanent magnet as claimed in claim 1, wherein M is Fe.

5. A permanent magnet as claimed in claim 1, wherein R is a combination of Nd and Dy.

* * * * *